United States Patent [19]

Kujawski et al.

[11] Patent Number: 4,967,432

[45] Date of Patent: Nov. 6, 1990

[54] BABY PLAYPEN-BASSINET COMBINATION

[75] Inventors: Stanley M. Kujawski, East Aurora; James E. Slowe, Scottsville, both of N.Y.

[73] Assignee: The Quaker Oats Company, Chicago, Ill.

[21] Appl. No.: 407,264

[22] Filed: Sep. 14, 1989

[51] Int. Cl.[5] ..... A47D 7/00

[52] U.S. Cl. ..... 5/98; 98.1; 5/99.1; 5/99 A; 5/122

[58] Field of Search ..... 5/93 R, 94, 98 R, 98 B, 5/99 A, 122

[56] References Cited

U.S. PATENT DOCUMENTS

| | | | |
|---|---|---|---|
| 961,669 | 6/1910 | Atkinson | 5/93 R |
| 1,204,416 | 11/1916 | Doser | 5/98 R |
| 2,553,087 | 5/1951 | Hanson | 5/93 R |
| 2,688,997 | 9/1954 | Miller | 5/98 R |
| 3,078,478 | 2/1963 | Sheanan | 5/93 R |
| 3,574,872 | 4/1971 | Mattila | 5/94 |
| 3,644,947 | 2/1972 | Padera | 5/93 R |
| 3,735,430 | 5/1973 | Platz | 5/94 |
| 4,073,017 | 2/1978 | Stevens | 5/98 R |
| 4,750,223 | 6/1988 | D'Arcy et al. | 5/98 R |

*Primary Examiner*—Gary L. Smith
*Assistant Examiner*—Michael Milano
*Attorney, Agent, or Firm*—Cumpston & Shaw

[57] ABSTRACT

A baby playpen-bassinet combination is disclosed in which the playpen has a bottom and four sides extending upwardly from the bottom, with one edge portion of the side secured to the bottom, and the opposite edge portions free. A bassinet is releasably mountable on the opposite free edge portions of the playpen for locating the bassinet in a more accessible position, requiring less bending and lifting in handling a baby for naps, diaper changing and dressing.

11 Claims, 1 Drawing Sheet

BABY PLAYPEN-BASSINET COMBINATION

BACKGROUND OF THE INVENTION

1. Field of the Invention

This invention relates generally to baby accessories, and more particularly to a baby playpen-bassinet combination.

2. Description of the Prior Art

Baby accessories, such as playpens and bassinets, are well-known in the art. In the prior art, the playpen and bassinet are separate items completely, and in no way do they cooperate with one another. When a mother returns from the hospital after delivering a baby, a need exists for a bassinet-type accessory that reduces the bending and lifting of the mother in handling the baby, for naps, diaper changing, dressing, or the like. This need is met by this invention, in providing a bassinet-type accessory that is mountable on the top of a playpen for locating the bassinet in a more accessible position for handling a baby.

SUMMARY OF THE INVENTION

An object of the present invention is to provide a baby playpen-bassinet combination comprising:

a playpen having a bottom and four sides extending upwardly from the bottom, with one edge portion of the side secured to the bottom, and the opposite edge portion free; and a bassinet releasably mountable on the opposite free edge portions of the playpen for locating the bassinet in a more accessible position for handling the baby.

A more specific object of the invention is to provide a baby playpen-bassinet combination, wherein attachment means are provided on the bassinet for releasably attaching the bassinet to the free edge portions of the playpen, and wherein the attachment means comprises a rigid hook member on the bassinet.

Still another object of the invention is to provide a playpen-bassinet combination wherein the playpen is provided with a rigid free edge portion, such as a tubular portion, covered by a playpen fabric, wherein the bassinet comprises a rigid hook member mountable on the rigid free edge portion and covered by a bassinet fabric, and wherein a border portion of the bassinet fabric defines an endless pocket which extends over the rigid hook member, and is secured thereto.

BRIEF DESCRIPTION OF THE DRAWINGS

In the detailed description of the invention presented below, reference is made to the accompanying drawings, in which.

DETAILED DESCRIPTION OF THE INVENTION

Figure 1:
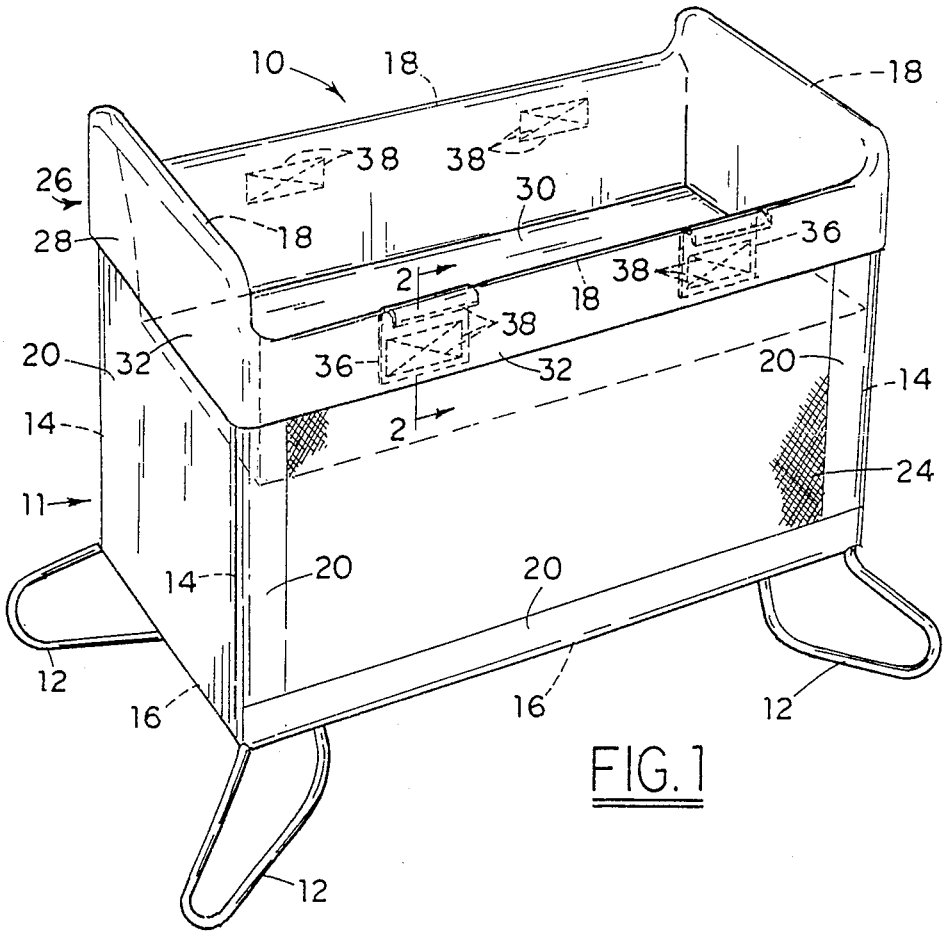
FIG. 1 is a perspective view of a preferred embodiment of the baby playpen-bassinet combination of this invention.

Because playpens and bassinets are well-known, the present description will be directed in particular to elements forming part of, or cooperating directly with, a baby playpen-bassinet combination, in accordance with the present invention. It is to be understood that elements not specifically shown or described may take various forms well-known to those skilled in the art.

With reference to FIGS. 1–4, a preferred embodiment of the baby playpen-bassinet combination 10 of this invention is disclosed. The playpen-bassinet comprises a playpen 11 having a playpen frame, preferably formed from any suitable tubular plastic or metal material. The tubular playpen frame has tubular or preferably molded plastic foot members 12, tubular corner posts 14, sewn bottom edge portions 16 adjacent the bottom of the playpen, and tubular top edge portions 18 forming the upper open end of the playpen. Although the tubular corner posts 14 and top edge portion 18 are not visible in FIG. 1, they are similar to the tubular edge portion 18 disclosed in FIGS. 2 and 3. The tubular frame is further covered by any suitable playpen fabric material 20 that preferably surrounds the tubular corner posts 14, and top and bottom edge portions 16, 18, and is also secured by stitching 22 or the like (FIG. 2) to any suitable mesh material 24 through which a person can visually observe a child within the playpen.

The bassinet 26 of the playpen-bassinet combination comprises a flexible box-like enclosure formed from any suitable bassinet fabric material 28. A floor mat, not shown, formed from any suitable rigid panels of hardboard or the like, encased within a bassinet fabric material, is loosely mountable on the bottom fabric material of the bassinet to form a rigid bassinet floor for supporting a baby or child. Any suitable resilient pad 30 can be mounted on top of the floor mat to provide a soft surface. The border portion 32 of the bassinet fabric material is bent back upon itself and preferably sewed to form an endless peripheral pocket 34 for receiving the rigid top edge portions 18 of the playpen 11 when the bassinet 26 is mounted thereon.

Figure 4:
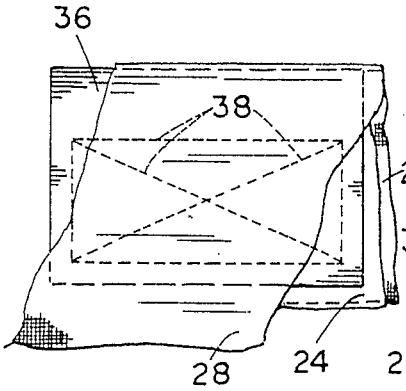
FIG. 4 is a left side elevational view of FIG. 2.
Figure 2:
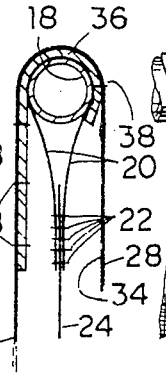
FIG. 2 is a segmental section view taken substantially along line 2—2 of FIG. 1.
Figure 3:
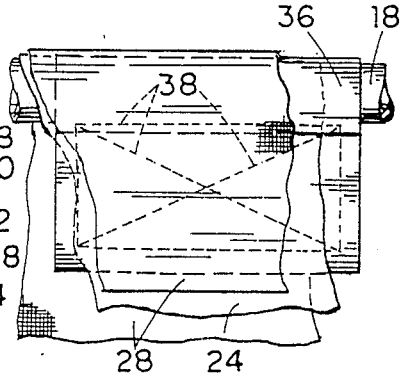
FIG. 3 is a right side elevational view of FIG. 2.

With reference to FIGS. 2–4, the attachment means for releasably attaching the bassinet 26 to the playpen 11 is disclosed. The attachment means in its broadest sense comprises the aforementioned endless pocket 34 along the periphery of the bassinet, which receives the rigid free edge portions 18 of the sides and ends of the playpen, when the bassinet is mounted thereon. To prevent the pocket material 34 of the bassinet from pulling away from the rigid free edge portion 18 of the playpen, particularly when a heavy child is placed in the playpen, a rigid hook-shaped clip 36, preferably formed from any suitable plastic material, is placed inside the bassinet pocket 34 and secured thereto by stitching 38 or the like, as best seen in FIG. 2. Although a single clip 36 on each side of the bassinet 26 has been found to be sufficient, any number of such clips may be utilized along one or more of the sides of the bassinet. It has also been found that by properly selecting the playpen and bassinet fabrics or materials 20, 28 respectively so that a high sliding frictional force exists therebetween, the likelihood of the pockets 34 pulling out from the free edge portions of the playpen is further reduced.

While a preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. A baby playpen-bassinet combination comprising:

a playpen having a frame, a bottom, and four fabric sides supported on the frame and extending upwardly from the bottom, with a bottom edge portion of each fabric side secured to the bottom and the opposite top edge portion terminating in an upstanding free edge; and a fabric bassinet releasably slidably mountable over the top edge portion of the playpen the bassinet comprising a pocket engageable with the top edge portion of the playpen and an infant supporting bottom recessed below the pocket.

2. A baby playpen-bassinet combination according to claim 1 wherein the top edge portions of the playpen are substantially rigid.

3. A baby playpen-bassinet combination according to claim 2 wherein the bassinet has an upper peripheral border, and wherein the pocket comprises an endless pocket formed by the border for receiving the rigid top edge portions of the playpen when the bassinet is mounted thereon.

4. A baby playpen-bassinet combination according to claim 2, wherein the bassinet comprises a rigid hook-shaped clip within the pocket releasably engageable with a rigid top edge portion of the playpen.

5. A baby playpen-bassinet combination according to claim 4, wherein the bassinet is formed from a bassinet fabric material, and the border portion of the bassinet fabric material extends over the rigid clip and is secured thereto.

6. A baby playpen-bassinet combination according to claim 5, wherein the playpen comprises a tubular frame covered by a playpen fabric material, and the rigid top edge portions comprise a tubular portion of the frame covered by the playpen fabric material.

7. A baby playpen-bassinet combination according to claim 6, wherein the playpen fabric material and the bassinet fabric material are selected of different materials having a high sliding surface frictional force relative to one another.

8. A fabric bassinet releasably mountable to an upper edge portion of a playpen having a frame, a bottom and four sides extending upwardly from the bottom, with a bottom edge portion of each side secured to the bottom and the opposite top edge portion terminating in an upstanding free edge and substantially rigid, wherein the bassinet comprises:

an upper peripheral border; and an endless pocket formed by the border for receiving the rigid top edge portions of the playpen when the bassinet is mounted thereon, and an infant supporting recessed bassinet bottom spaced below the upper peripheral border.

9. A bassinet according to claim 8, further comprising a rigid hook-shaped clip on the bassinet, releasably engageable with a rigid top edge portion of the playpen.

10. A bassinet according to claim 9, wherein the bassinet is formed from a bassinet fabric material, and the border portion of the bassinet fabric material extends over the rigid clip and is secured thereto.

11. A bassinet according to claim 10, wherein the bassinet fabric material is selected to have a high sliding surface frictional force relative to the playpen.

* * * * *